US005476141A

United States Patent [19]

Tanaka

[11] Patent Number: 5,476,141

[45] Date of Patent: Dec. 19, 1995

[54] FLAT-TYPE REFRIGERANT TUBE HAVING AN IMPROVED PRESSURE-RESISTANT STRENGTH

[75] Inventor: Hiroshi Tanaka, Isesaki, Japan

[73] Assignee: Sanden Corporation, Isesaki, Japan

[21] Appl. No.: 229,668

[22] Filed: Apr. 19, 1994

[30] Foreign Application Priority Data

Apr. 19, 1993 [JP] Japan ..... 5-091275

[51] Int. Cl.[6] ..... F28F 1/40

[52] U.S. Cl. ..... 165/173; 165/179; 165/183

[58] Field of Search ..... 165/173, 179, 165/183

[56] References Cited

U.S. PATENT DOCUMENTS

| | | | |
|---|---|---|---|
| 3,596,495 | 8/1971 | Huggins | 72/367 |
| 5,058,266 | 10/1991 | Knoll | 29/890.049 |
| 5,186,246 | 2/1993 | Halstead | 165/140 |
| 5,219,017 | 6/1993 | Halstead et al. | 165/41 |

FOREIGN PATENT DOCUMENTS

| | | | |
|---|---|---|---|
| 6243491 | 2/1984 | Japan . | |
| 711576 | 8/1987 | Japan . | |
| 3-251688 | 11/1991 | Japan | 165/183 |

*Primary Examiner*—Allen J. Flanigan
*Attorney, Agent, or Firm*—Baker & Botts

[57] ABSTRACT

A flat-type refrigerant tube for use in an heat exchanger which has a plurality of refrigerant passage chambers formed in a flat aluminum plate having a first end and a second end, the chambers extending from the one end to the opposite end in parallel with first another and arranged in a plane parallel to the flat outer surface of the flat tube, each of the chambers having a rectangular cross-section with four corners which is determined by a first pair of opposite sides with a dimension of A and a second pair of opposite sides with a dimension of B perpendicular to the first pair of opposite sides. Each of the four corners is formed with a curvature R determined by the following formula: 0.2 mm≦R≦D/2, where D equals A when A≦B but equals B when B<A. Each of the chambers can be provided with at least one of elongated ribs longitudinally extending on the inner surface thereof.

12 Claims, 5 Drawing Sheets

FLAT-TYPE REFRIGERANT TUBE HAVING AN IMPROVED PRESSURE-RESISTANT STRENGTH

BACKGROUND OF THE INVENTION

This invention relates to a refrigerant tube of a flat type for circulating a refrigerant and to a heat exchanger using the refrigerant tube. Such a heat exchanger is particularly useful in an air-conditioning device for an automobile.

A heat exchanger is classified into various types such as a multiflow condenser, a serpentine heat exchanger, a heater core, and a radiator and uses a bank of refrigerant tube or tubes of a flat type for circulating a refrigerant.

The flat-type refrigerant tube generally comprises a flat aluminum plate having a given length. The aluminum plate is provided with a plurality of refrigerant passage chambers (hereinafter simply called chambers) extending therein along its longitudinal direction and arranged in parallel with one another in a plane parallel to the plate. Each of the chambers has a rectangular cross-section and is defined by a first pair of wall surfaces parallel with and opposite to each other and a second pair of wall surfaces parallel with and opposite to each other and perpendicular to the first pair of wail surfaces. The first pair of wall surfaces connect to the second pair of the wall surfaces to form four corners of the chamber.

The heat exchanger is required to have a high heat exchange efficiency. One of the factors to determine the heat exchange efficiency is a heat-transfer area of the refrigerant. Generally, a greater heat-transfer area achieves a higher heat exchange efficiency. Accordingly, the heat exchanger is required to have a large heat-transfer area of the refrigerant.

In the heat exchanger using the flat-type refrigerant tube, the heat-transfer area of the refrigerant corresponds to a total area of the first and the second pairs of the wall surfaces defining each of the chambers in the flat-type refrigerant tube.

In the flat-type refrigerant tube known in the art, each corner in each of the chambers is formed to have a right angle in order to increase the heat-transfer area of the refrigerant. Typically, the flat-type refrigerant tube is manufactured through an extrusion molding process using a die. Due to the restraint upon manufacture of the die itself, each corner actually has an inevitable small curvature R. The inevitable small curvature R is approximately equal to 0.05 mm.

Another approach to increase the heat-transfer area is additionally adopted in the prior art of the flat-type refrigerant tube. The approach is to make the flat-type refrigerant tube have elongated protrusions or ribs formed on at least one of the first and the second pairs of wall surfaces of each chamber and extending along a longitudinal direction thereof. For example, each of Japanese Design Registrations Nos. 624349-1 and 711576 discloses the flat-type refrigerant tube having those protrusions or ribs.

However, the conventional flat-type refrigerant tube with the corners having a right angle or an inevitable small curvature R is disadvantageous in that a pressure-resistant strength is low due to its configuration. When assembled into the heat exchanger and practically used, the flat-type refrigerant tube is subjected to a stress due to the pressure of the refrigerant. In this situation, the low pressure-resistant strength would cause a serious problem. In detail, the stress due to the pressure of the refrigerant tends to concentrate onto the corners. Thus, the corners can easily be damaged and therefore have a less durability. In order to solve the problem about the pressure-resistant strength in the conventional flat-type refrigerant tube, walls defining a plurality of the chambers are increased in thickness. However, the increase in thickness of the walls is disadvantageous because it results in deterioration of the heat exchange efficiency and increase of the weight of the flat-type refrigerant tube.

SUMMARY OF THE INVENTION

It is therefore an object of this invention to provide a flat-type refrigerant tube having an increased heat exchange efficiency and an improved pressure-resistant strength.

It is another object of this invention to provide a flat-type refrigerant tube which is capable of achieving the above-mentioned object without increasing the weight.

It is a further object of this invention to provide a heat exchanger using the flat-type refrigerant tube achieving the above-mentioned object.

According to this invention, there is provided a refrigerant tube of a flat type which comprises a flat aluminum plate having a length from a first end to a second end, the plate having a plurality of chambers extending therein from the one end to the opposite end and arranged in parallel with each other in a plane parallel to the plate, each of the plurality of chambers being defined to have a rectangular cross-section by a first pair of wall surfaces which are parallel with and separated by a first dimension D from each other and a second pair of wall surfaces which are parallel with and separated by a second dimension greater than or equal to said first dimension from each other and perpendicular to the first pair of wall surfaces, the first pair of wall surfaces connecting to the second pair of wall surfaces to form four corners of each of the chambers having the rectangular cross-section, each of the corners being formed with a curvature R determined by the following formula:

$$0.20\ \text{mm} \leq R \leq D/2.$$

DESCRIPTION OF THE PREFERRED EMBODIMENTS

Referring to FIGS. 1 through 4, description will at first be made as regards a conventional flat-type refrigerant tube for a better understanding of this invention.

Figure 1:
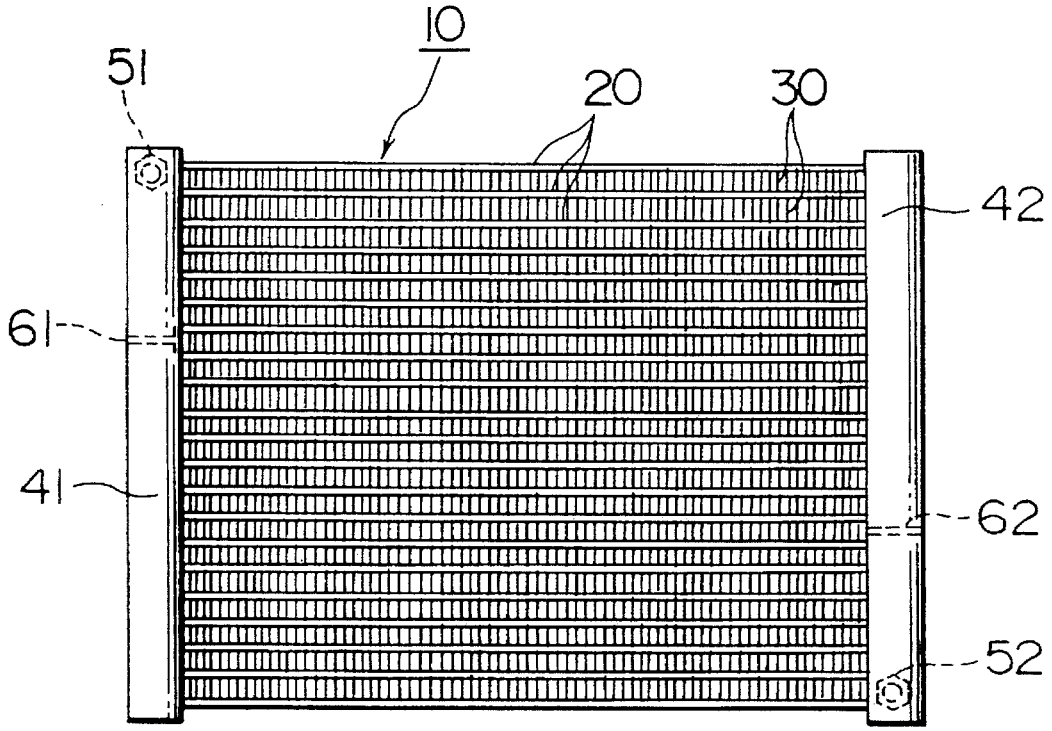
FIG. 1 is a front view of a heat exchanger using conventional flat-type refrigerant tubes.
Figure 2:
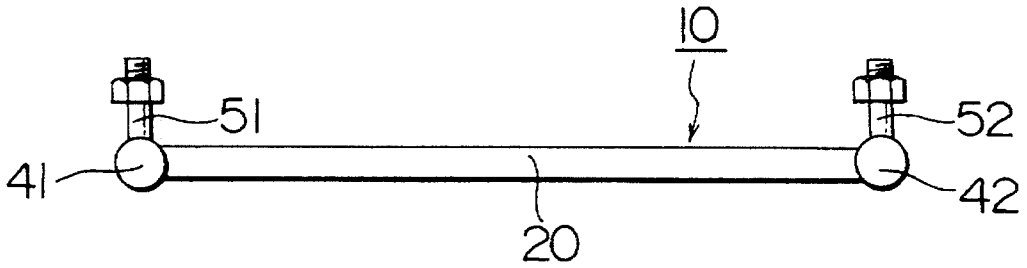
FIG. 2 is a top view of the heat exchanger illustrated in FIG. 1.

Referring to FIGS. 1 and 2, a heat exchanger 10 of a type generally called a multiflow condenser comprises a bank of conventional flat-type refrigerant tubes. The heat exchanger 10 comprises a plurality of flat-type refrigerant tubes 20 having a single identical length and arranged in parallel at a predetermined interval, a plurality of corrugated radiator fins 30 attached to the flat-type refrigerant tubes 20 to be interposed between each adjacent pair of the flat-type refrigerant tubes 20, and a pair of header pipes 41 and 42 connected to the flat-type refrigerant tubes 20 at first ends and second ends of each of the flat-type refrigerant tubes 20, respectively. Each of the flat-type refrigerant tubes has a plurality of chambers which will later be described in detail. The first ends and second ends of the flat-type refrigerant tubes 20 are inserted into a plurality of notches formed in peripheral surfaces of the header pipes 41 and 42 and are bonded to the header pipes 41 and 42, respectively. With the above-mentioned structure, the chambers in the flat-type refrigerant tubes 20 communicate with the interior of each of the header pipes 41 and 42.

As illustrated in FIG. 1, an inlet pipe 51 is inserted and fitted into the header pipe 41 in the vicinity of its upper end to introduce a refrigerant into the header pipe 41 therethrough. A partitioning plate 61 is formed in the interior of the header pipe 41 at a position nearer to the upper end than to the lower end. With this structure, the interior of the header pipe 41 is partitioned into an upper space located above the partitioning plate 61 and communicating with the inlet pipe 51 and a lower space below the partitioning plate 61. The upper and the lower spaces occupy approximately one-third and approximately two-thirds of the internal volume of the header pipe 41, respectively.

On the other hand, an outlet pipe 52 is inserted and fitted into the header pipe 42 in the vicinity of its lower end to discharge the refrigerant therethrough. A partitioning plate 62 is formed in the interior of the header pipe 42 at a position nearer to the lower end than to the upper end. With this structure, the interior of the header pipe 42 is partitioned into a lower space located below the partitioning plate 62 and communicating with the outlet pipe 52 and an upper space above the partitioning plate 62. The lower and the upper spaces occupy approximately one-third and approximately two-thirds of the internal volume of the header pipe 42, respectively.

The heat exchanger 10 having the above-mentioned structure carries out a heat exchange operation in the manner which will now be described.

At first, description will be made as regards a refrigerant flow within the heat exchanger 10. The refrigerant introduced through the inlet pipe 51 flows into the upper space of the header pipe 41 above the partitioning plate 61. Then, the refrigerant flows into the chambers of the flat-type refrigerant tubes 20 of an upper group connected to the upper space of the header pipe 41 higher than the partitioning plate 61 in a rightward direction and then, flows into the upper space of the header pipe 42 above the partitioning plate 62. The refrigerant further flows therefrom through the chambers of the flat-type refrigerant tubes 20 of an intermediate group connected to the lower space of the header pipe 41 lower than the partitioning plate 61 and also to the upper space of the header 42 higher than the partitioning plate 62 in a leftward direction into the lower space of the header pipe 41 below the partitioning plate 61. Thereafter, the refrigerant flows therefrom through the chambers of the flat-type refrigerant tubes 20 of a lower group connected to the lower space of the header 41 lower than the partitioning plate 61 and also to the lower space of the header 42 lower than the partitioning plate 62 in a rightward direction into the lower space of the header pipe 42 below the partitioning plate 62. The refrigerant is discharged therefrom through the outlet pipe 52 to the outside of the heat exchanger 10.

As described above, the refrigerant flowing through the inlet pipe 51 into the heat exchanger 10 circulates successively through the chambers of the flat-type refrigerant tubes 20 of the upper, the intermediate, and the lower groups along the rightward, the leftward, and the rightward directions in FIG. 1, respectively, to flow out through the outlet pipe 51. In other words, the refrigerant is circulated in a zigzag fashion. Circulating in a zigzag fashion, the refrigerant performs heat radiation through the walls of the flat-type refrigerant tubes 20 and the heat radiator fins 30. Thus, the heat exchange operation is carried out by the heat exchanger 10.

Next, description will be made in detail as regards the flat-type refrigerant tubes 20.

Figure 3:
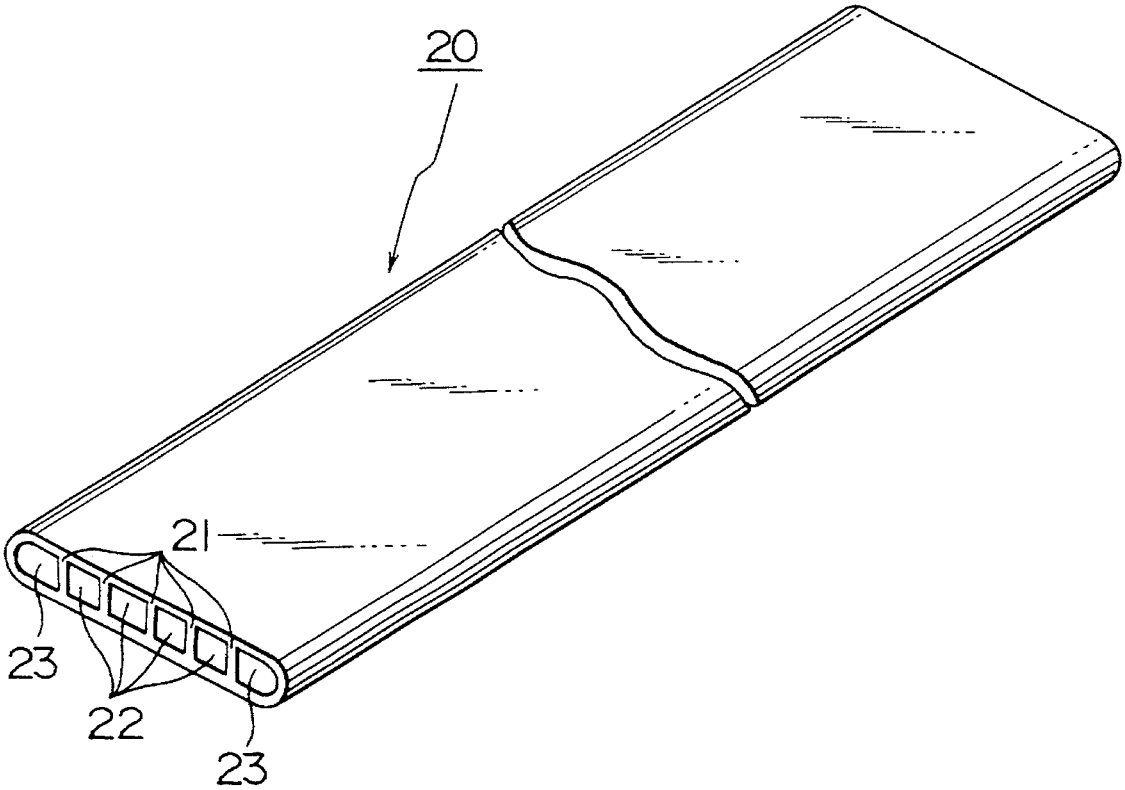
FIG. 3 is a perspective view of a single one of the conventional flat-type refrigerant tubes used in the heat exchanger illustrated in FIG. 1.
Figure 4:
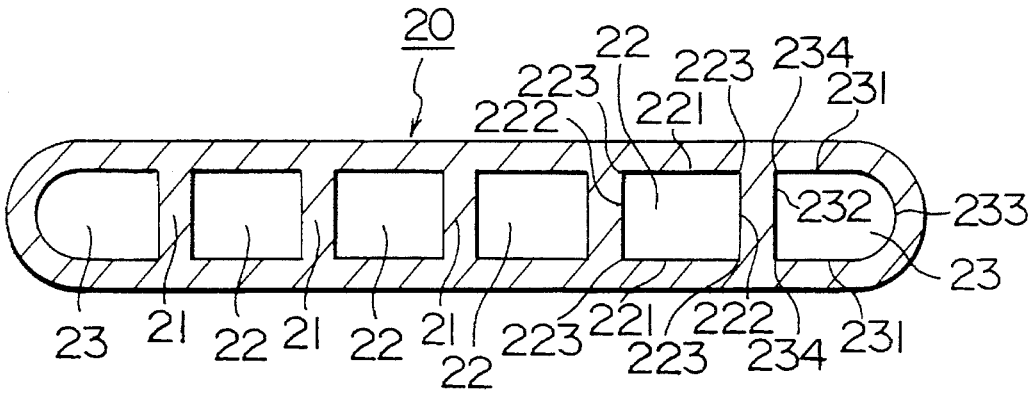
FIG. 4 is a cross-sectional view of the conventional flat-type refrigerant tube illustrated in FIG. 3.

FIG. 3 shows a perspective view of a single one of the flat-type refrigerant tubes 20. FIG. 4 shows a cross-sectional view of the single flat-type refrigerant tube 20 taken along a plane perpendicular to its extending direction. In the example illustrated, the flat-type refrigerant tube 20 has a plurality of chambers defined by five partitioning walls 21. The chambers extend in parallel to one another in a plane parallel to the flat outer surface of the flat tube. Those chambers include four inside chambers 22 and two outermost chambers 23 located at outermost positions in the parallel chamber group. The flat-type refrigerant tube 20 is made of aluminum through an extrusion molding process. It is noted here that the number of the chambers is not restricted to that illustrated in the figure and may be any desired number depending upon various demands required to different products.

Each of the four inside chambers 22 has a rectangular cross-section and is defined by a pair of wall surfaces 221 parallel to each other with a predetermined space left therebetween and another pair of wall surfaces 222 parallel to each other with a preselected space left therebetween and perpendicular to the pair of wall surfaces 221. The pair of the wall surfaces 221 connect to the pair of the wall surfaces 222 to form four corners 223 of the chamber 22 having the rectangular cross-section.

On the other hand, each of the two outermost chambers 23 has a U-shaped cross-section and is defined by a pair of wall surfaces 231 parallel to each other with a predetermined space ].eft therebetween, a wall surface 232 perpendicular to the pair of wall surfaces 231, and a curved wall surface 233 opposite to the wall surface 232. The pair of wall surfaces 231 connect to the wall surface 232 to form two corners 234 of the chamber 23 having the U-shaped cross-section.

The curved wall surface 233 exhibits a curved shape corresponding to an outer curved surface of each of side walls of the flat-type refrigerant tube 20.

In the flat-type refrigerant tube 20, the corners 223 and 234 are formed to have a right angle in order to increase the heat-transfer area of the refrigerant. However, each of the corners 223 and 234 actually has an inevitable small curvature R as described above. Inasmuch as the flat-type refrigerant tube 20 is manufactured through the extrusion molding process as described above, the configuration of each of the corners 223 and 234 is defined by the profile of the edges in an extrusion molding die. As the die is typically manufactured by a wire-cut electric spark machining process, the profile of the edges in the die depends upon the diameter of a spark wire used in manufacturing the die. Specifically, the inevitable small curvature R of the corners 223 and 234 is approximately equal to 0.05 mm which is a radius of the spark wire used.

Now, description will be made as regards flat-type refrigerant tubes according to preferred embodiments of this invention with reference to FIGS. 5 through 8.

Figure 5:
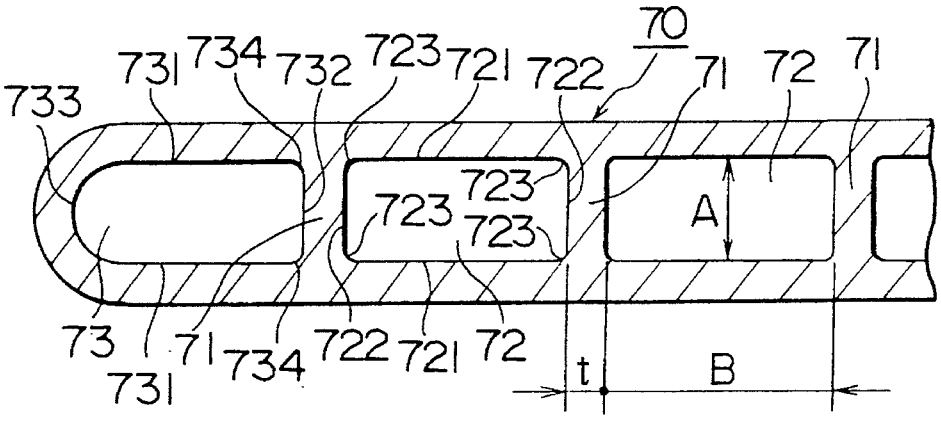
FIG. 5 is a cross-sectional partial view of a flat-type refrigerant tube according to a first embodiment of this invention.

Referring to FIG. 5, a flat-type refrigerant tube 70 according to a first embodiment of this invention is of a flat type and made of an aluminum plate through an extrusion molding process, like the flat-type refrigerant tube described in conjunction with FIGS. 3 and 4. The flat-type refrigerant tube 70 has a plurality of parallel chambers partitioned by a plurality of partitioning walls 71. In the figure, only two inside chambers 72 and a leftmost chamber 73 are shown for simplicity of illustration. Each of the inside chambers 72 is defined by two adjacent ones of the partitioning walls 71 (having a height A) perpendicular to a flat plane of the flat-type refrigerant tube 70 and upper and lower walls (having a width B) parallel to the flat plane. Thus, each inside chamber 72 has a rectangular section having a dimension represented by A×B. Specifically, each of the inside chambers 72 has the rectangular cross-section and is defined by a pair of wall surfaces 721 parallel to each other with a dimension A (equal to the wall height A) left therebetween and another pair of wall surfaces 722 parallel with each other with a dimension B greater than the space A left therebetween and perpendicular to the pair of wall surfaces 721. The pair of wall surfaces 721 connect to the pair of wall surfaces 722 to form four corners 723 of the chamber 72 having the rectangular cross-section.

On the other hand, the leftmost chamber 73 is defined by the leftmost one of the partitioning walls 71, the upper and the lower walls, and a leftside outer wall of the tube. Although not shown in the figure, a rightmost one of the refrigerant chambers 73 has a similar structure as the leftmost one. Specifically, each of the outermost chambers 73 has a U-shaped cross-section defined by a pair of wall surfaces 731 parallel with each other with the dimension A left therebetween, a wall surface 732 perpendicular to the pair of wall surfaces 731, and a curved wall surface 733 opposite to the wall surface 732. The pair of wall surfaces 731 connect to the wall surface 732 to form two corners 734 of the chamber 73 having a U-shaped cross-section.

Although the curved wall surface 733 exhibits a curved shape corresponding to an outer curved surface of the side walls of the refrigerant tube 70, it may be a flat surface like the wall surface 732.

According to the invention, each of the corners 723 and 734 is formed with a curvature R which is equal to about 0.2 mm. It is noted here that the curvature R may have any value greater than or equal to about 0.2 mm according to this invention. Preferably, the curvature R has an upper limit determined by R=A/2 where A represents the above-mentioned dimension. Thus, each of the corners 723 and 734 desirably has a curvature R determined by $0.2\ \text{mm} \leqq R \leqq A/2$.

Thus, the chamber 72 has the dimensions A and B in directions perpendicular to and parallel to the flat plane of the refrigerant tube 70, respectively. In the example being illustrated, the dimension A is selected to be smaller than the dimension B in a usual manner. However, the dimension A may be greater than the dimension B. Alternatively, the both dimensions A and B may be equal to each other. At any rate, the curvature R is restricted by the upper limit D/2 where D is a smaller one of the dimensions A and B or a single common dimension if the both dimensions are equal to each other. This is because a smooth wall surface can not be obtained if the curvature R is greater than D/2.

Next, calculation is made of a theoretical breaking or fracture strength (Kgf/mm$^2$) to evaluate the pressure-resistant strength of the refrigerant tube 70 according to this embodiment. As known in the art, the theoretical fracture strength (Kgf/mm$^2$) is calculated by $(t/B)\times\sigma$, where t represents the thickness (mm) of the partitioning wall 71 and $\sigma$ represents the breaking load or tensile strength (Kgf/mm$^2$) of a tube material. In the experimental study, a sample of the refrigerant tube 70 was measured to have the thickness t and the dimension B equal to 0.323 mm and 1.22 mm, respectively. The sample tube was made of an aluminum material (JIS Al050-O) having the tensile strength $\sigma$ equal to 6.0 (Kgf/mm$^2$). From these values, the theoretical fracture strength for the refrigerant tube 70 (R=0.2 mm) was calculated to be equal to 1.6 (Kgf/mm$^2$). On the other hand, the actual fracture strength was measured to be equal to 2.2 (Kgf/mm$^2$).

As a comparative example, the measurement of the actual fracture strength was also carried out for the conventional refrigerant tube 20 (R=0.05 mm) illustrated in FIG. 3. The conventional refrigerant tube 20 had the thickness t, the dimension B, and the tensile strength $\sigma$, all of which were similar to those of the refrigerant tube 70 and therefore had the same theoretical fracture strength of 1.6 (Kgf/mm$^2$). The actual fracture strength as measured was equal to 1.6 (Kgf/mm$^2$) quite identical with the theoretical value.

As readily understood from the result of the measurement, the flat-type refrigerant tube with the corners having the curvature R equal to about 0.2 mm is excellent in fracture strength as compared with the flat-type refrigerant tube with the corners having the curvature R equal to 0.05 mm or less.

Next, description will be made as regards the experimental test to prove that the flat-type refrigerant tube with the corners having the curvature R equal to about 0.2 mm or more is excellent in fracture strength. For the test, six flat-type refrigerant tubes were prepared with different curvatures R equal to about 0.05, 0.10, 0.15, 0.20, 0.25, and 0.30, respectively. Except the curvatures R, all of the flat-type refrigerant tubes have a structure similar to the sample of the refrigerant tube 70 mentioned above.

Figure 9:
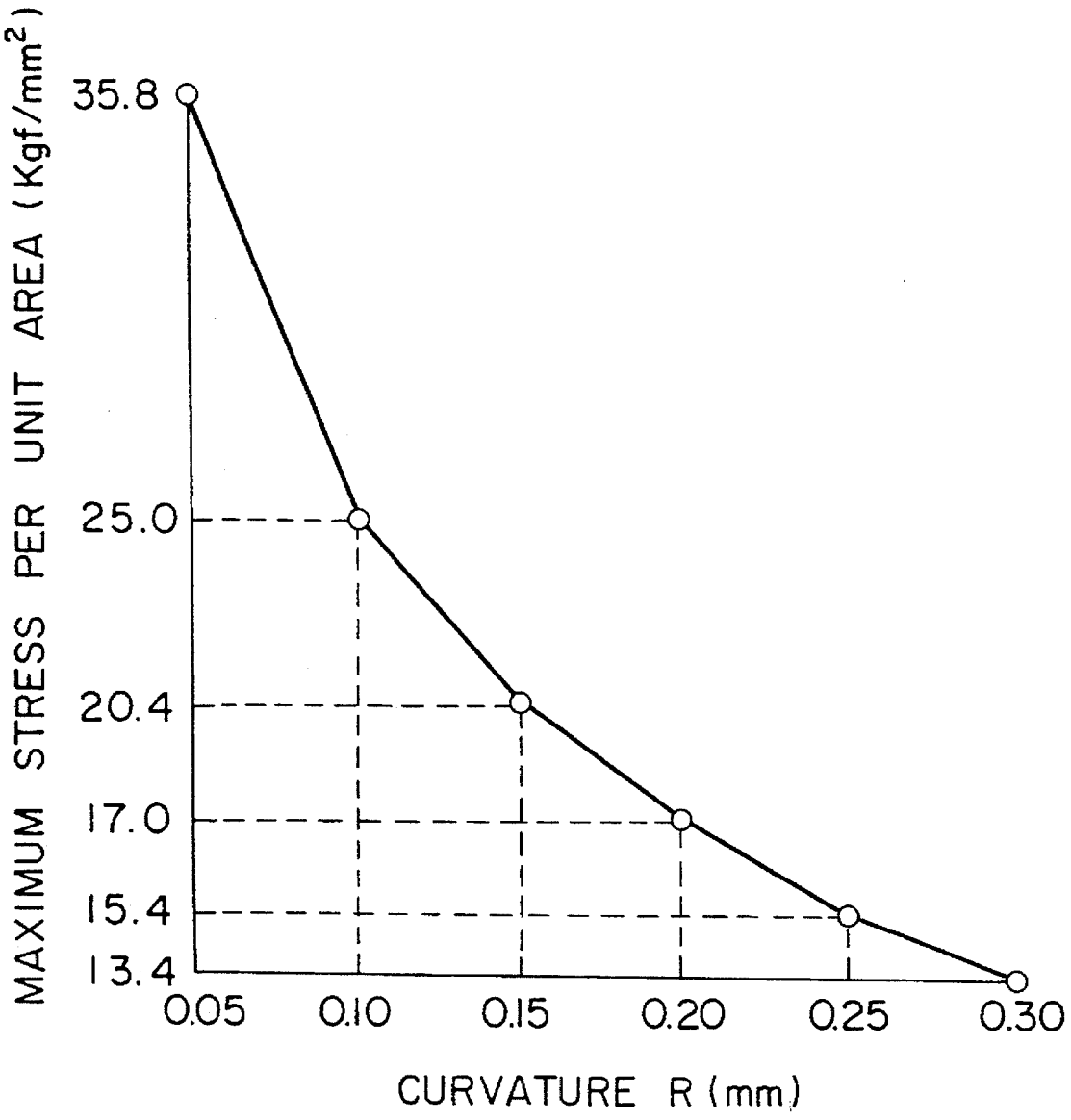
FIG. 9 is a graph showing the relationship between the maximum stress per unit area applied onto a corner and the curvature R of the corner in each of the flat-type refrigerant tubes according to the first and the second embodiments of this invention.

For each of the six refrigerant tubes, measurement was made of the maximum stress per unit area at the corner under a constant inner pressure of each chamber. The measured result is illustrated in FIG. 9. In FIG. 9, an abscissa and an ordinate represent the curvature R (mm) of the corner and the maximum stress per unit area (Kgf/mm$^2$) at the corner, respectively. Referring to FIG. 9, it will be understood that the maximum stress per unit area at the corner is decreased with an increase of the curvature R of the corner. Since the level of the fracture strength of the refrigerant tube depends upon the magnitude of the maximum stress per unit area at the corner, it is desirable that the maximum stress per unit area at the corner is small. Accordingly, it will be understood from FIG. 9 that the greater curvature R provides a higher fracture strength and is therefore preferable. It is assumed here that the maximum stress per unit area (e.g., 35.8 Kgf/mm$^2$) at the corner having the conventional curvature R (e.g., 0.05 mm) is 100%. In this event, the maximum stress per unit area (e.g., 17.0 Kgf/mm$^2$) for the curvature R of about 0.2 mm is approximately equal to 47%. If this percentage is not greater than 50%, the refrigerant tube has a sufficient fracture strength. Accordingly, the curvature R of the corner must be equal to 0.2 mm or more.

As a variation, consideration will be directed to the case where the calculated theoretical value is sufficient as the fracture strength required to the refrigerant tube in practical use. In this event, when the curvature R of the corner is selected to be about 0.2 mm or more, the thicknesses of the walls can be reduced while maintaining the sufficient fracture strength. It will readily be understood that the reduced wall thickness can make the exchanger excellent in the heat exchange efficiency and light in weight. In other words, the curvature R greater than or equal to about 0.2 mm will achieve the improvement of the heat exchange efficiency and reduction of the weight of the refrigerant tube.

Figure 6:
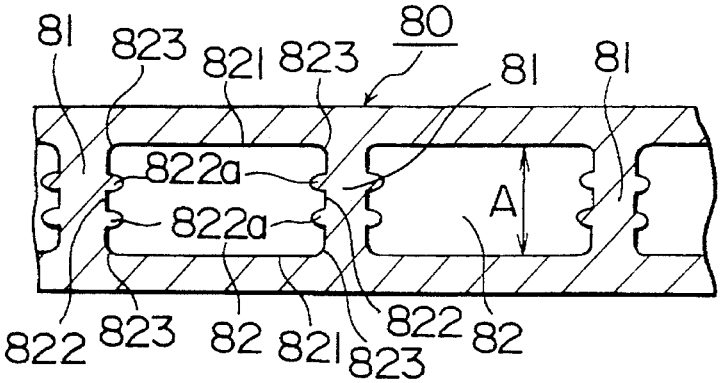
FIG. 6 is a cross-sectional partial view of a flat-type refrigerant tube according to a second embodiment of this invention.
Figure 7:
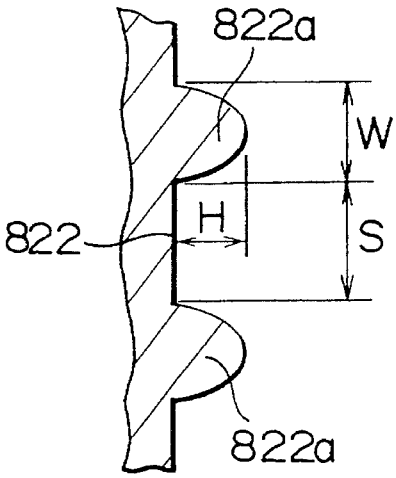
FIG. 7 is an enlarged view of a main portion of the cross-sectional view illustrated in FIG. 6.

FIG. 6 is a sectional view of a part of a flat-type refrigerant tube 80 according to a second embodiment of this invention. FIG. 7 is a sectional view for describing in further detail elongated protrusions or ribs formed in the refrigerant tube 80 illustrated in FIG. 6. FIGS. 6 and 7 are both taken along a plane perpendicular to the extending direction of the refrigerant tube 80. In the following description, the similar parts to those illustrated in FIG. 4 will not be described in detail again.

Referring to FIG. 6, the refrigerant tube 80 of a flat type has a plurality of chambers 82 (only two chambers are illustrated in the figure) partitioned by a plurality of partitioning walls 81 (only three partitioning walls are shown in the figure). The number of the chambers may be selected to be any appropriate number depending upon the demands required to the different products.

Each of the chambers 82 has a substantially rectangular cross-section and is defined by a pair of wall surfaces 821 parallel to each other with a dimension A left therebetween and another pair of wall surfaces 822 parallel to each other with a dimension greater than or equal to the dimension A left therebetween and perpendicular to the pair of wall surfaces 821. The pair of wall surfaces 821 connect to the pair of wall surfaces 822 to form four corners 823 of the chamber 82 having the substantially rectangular section.

Each of the four corners 823 exhibits a curvature R equal to about 0.2 mm. It is noted here the curvature R may be any value determined by $0.2\ \text{mm} \leqq R \leqq A/2$ in this second embodiment also as described in conjunction with the first embodiment.

Each of the wall surfaces 822 has two elongated protrusions 822*a* extending along a longitudinal direction of the chamber 82. It is noted here that the number and the positions of the elongated protrusions are not restricted to those illustrated in FIG. 6.

Although the configuration of the elongated protrusions is not restricted to that illustrated in FIG. 6, it is preferable to satisfy the following conditions in view of the heat exchange efficiency. Referring to FIG. 7 in addition, a plurality of the elongated protrusions 822*a* each having a pair of rising edges separated by a width W are arranged in parallel to one another with the distance S left between rising edges of the adjacent ones of the elongated protrusions 822*a*. In this event, it is preferable that the relationship $S \leqq W$ is satisfied in view of the heat exchange efficiency. Furthermore, the height H of the elongated protrusions 822*a* preferably has a value determined by $4.5 \times W \leqq H$ in view of the heat exchange efficiency.

As described, the flat-type refrigerant tube 80 is provided with the elongated protrusions formed on the surface of the partitioning walls between the adjacent chambers. With this structure, the similar strength is obtained as that of the refrigerant tube having the partitioning walls of an increased thickness without deteriorating the heat exchange efficiency. Thus, the fracture strength of the flat-type refrigerant tube is effectively improved.

Figure 8:
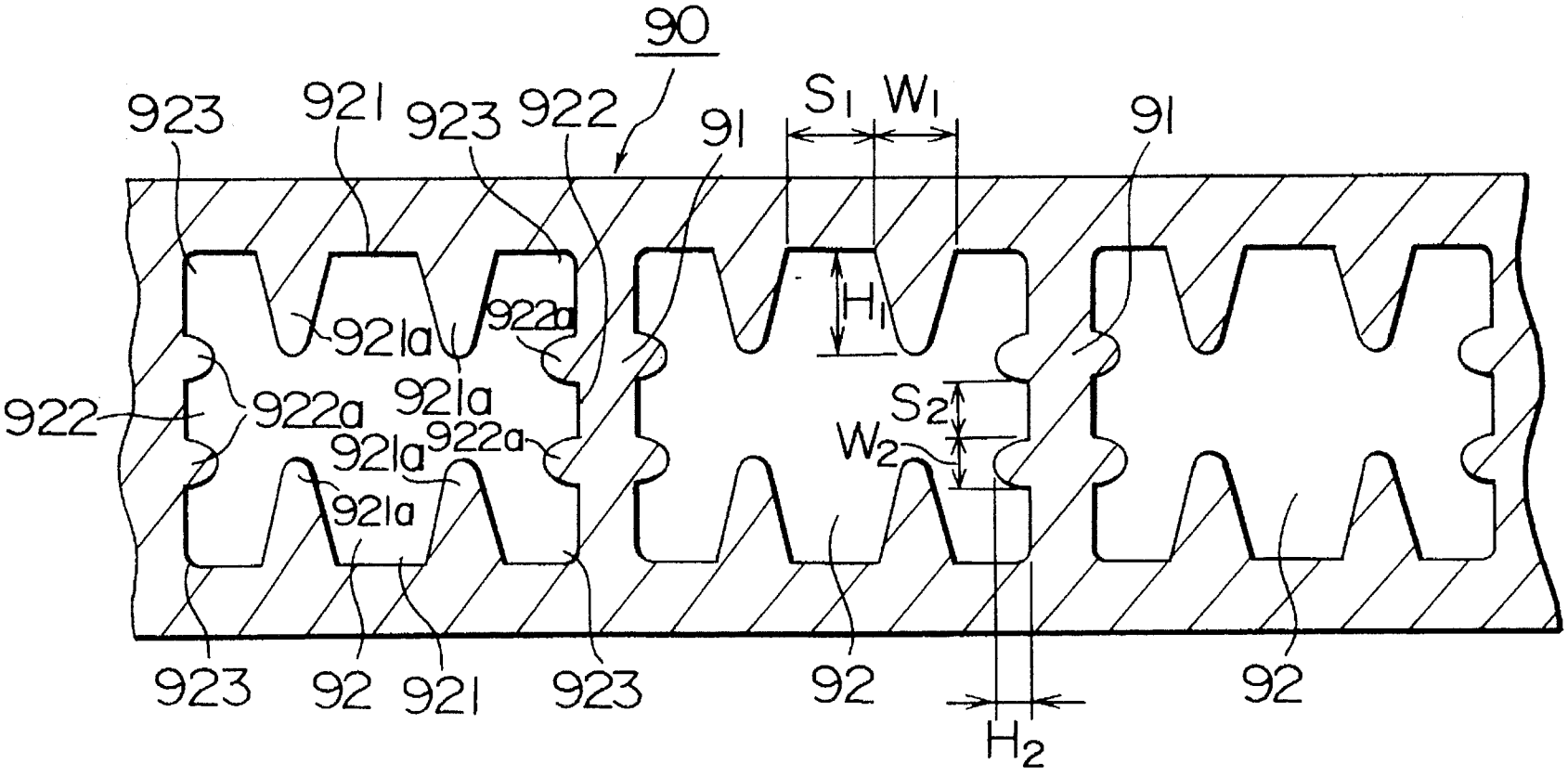
FIG. 8 is a cross-sectional partial view of a flat-type refrigerant tube according to a third embodiment of this invention.

FIG. 8 is a sectional view of a part of a flat-type refrigerant tube 90 according to a third embodiment of this invention. FIG. 8 is a sectional view taken along a plane perpendicular to the extending direction of the refrigerant tube 90. In the following description, similar parts as those illustrated in FIG. 3 will not be described in detail any longer.

Referring to FIG. 8, the refrigerant tube 90 of a flat type has a plurality of chambers 92 (only three chambers are shown in the figure) partitioned by a plurality of partitioning walls 91. The number of the chambers is not restricted to that illustrated in FIG. 8 and may be any desired number depending upon various demands required to the different products.

Each of the chambers 92 has a substantially rectangular cross-section and is defined by a pair of wall surfaces 921 parallel to each other with a dimension A left therebetween and another pair of wall surfaces 922 parallel to each other with a space not smaller than the space A left therebetween and perpendicular to the pair of wall surfaces 921. The pair of wall surfaces 921 connect to the pair of wall surfaces 922 to form four corners 923 of the chamber 92 having the substantially rectangular cross-section.

Each of the four corners 923 has a curvature R equal to about 0.2 mm. It is noted that the curvature R may be any value determined by $0.2\ \text{mm} \leqq R \leqq A/2$ according to the third invention also as explained in conjunction with the first embodiment.

Each of the wall surfaces 921 has two elongated protrusions 921*a* extending along the longitudinal direction of the chamber 92. On the other hand, each of the wall surfaces 922 has two elongated protrusions 922*a* extending along the longitudinal direction of the chamber 92. The numbers and the positions of the elongated protrusions are not restricted to those illustrated in FIG. 8. Although the configuration of the elongated protrusions is not restricted to that illustrated in FIG. 8, it is preferable to satisfy the following conditions in view of the heat exchange efficiency of the refrigerant tube.

Referring to FIG. 8, a plurality of the elongated protrusions 921*a* each having a pair of rising edges separated by a width W1 are arranged in parallel to one another with the distance S1 left between the rising edges of the adjacent ones of the elongated protrusions 921*a*. Likewise, a plurality of the elongated protrusions 922*a* each having a pair of rising edges separated by a width W2 are arranged in parallel to one another with the distance S2 left between the rising edges of the adjacent ones of the elongated protrusions 922*a*. In this event, it is preferable that the relationships $S1 \leqq W1$ and $S2 \leqq W2$ are satisfied in view of the heat exchange efficiency. Furthermore, the heights H1 and H2 of the elongated protrusions 921*a* and 922*a* preferably have values determined by $4.5 \times W1 \leqq H1$ and $4.5 \times W2 \leqq H2$, respectively, in view of the heat exchange efficiency.

As described, the flat-type refrigerant tube 90 is provided with the elongated protrusions formed on all of the wall surfaces defining the chambers. With this structure, the similar strength is obtained as that of the refrigerant tube having the tube wall and the partition walls of an increased thickness without deteriorating the heat exchange efficiency.

Thus, the fracture strength of the refrigerant tube is effectively improved.

What is claimed is:

1. A refrigerant tube of a flat type which comprises a flat aluminum plate having a length from a first end to a second end, said plate having a plurality of chambers extending therein from the first end to the second end and arranged in parallel with each other in a plane parallel to said plate, each of said plurality of chambers being defined to have a rectangular cross-section by a first pair of wall surfaces which are parallel with and separated by a first dimension D from each other and a second pair of wail surfaces which are parallel with and separated by a second dimension greater than or equal to said first dimension from each other and perpendicular to said first pair of wall surfaces, said first pair of wall surfaces connecting to said second pair of wall surfaces to form four comers of each of said chambers having said rectangular cross-section, each of said comers being formed with a curvature R determined by the following formula:

$$0.2\ \text{mm} \leqq R \ll D/2.$$

2. A refrigerant tube as claimed in claim 1, wherein at least said first pair of wall surfaces in each of said plurality of chambers has at least one elongated protrusion extending from said first end to said second end in parallel with said plurality of chambers.

3. A refrigerant tube as claimed in claim 2, wherein a plurality of said elongated protrusions each having a pair of rising edges separated by a width W are formed on at least said first pair of wall surfaces with a distance S remaining between rising edges of two adjacent ones of said elongated protrusions, said width W and said distance S being determined by the following formula:

$$S \leqq W.$$

4. A refrigerant tube as claimed in claim 2, wherein said at least one elongated protrusion has a width W and a height H determined by the following formula:

$$4.5 \times W \leqq H.$$

5. A refrigerant tube of a first type which comprises a flat aluminum plat having a length from a first end to a second end, said plate having a plurality of chambers extending therein from the first end to the second end and arranged in parallel with each other in a plane parallel to said plate, said plurality of chambers comprising two outermost chambers and inner chamber disposed between said two outermost chambers, each of said two outermost chambers having a U-shaped cross section and being defined by a pair of wall surfaces which are parallel to said plane and separated from each other by a first dimension A left therebetween, a curved wall surface being an inner surface of each of outermost opposite side walls of said tube and connecting between said pair of walls, and a wall surface being opposite to said curved wall surface and perpendicular to the pair of wall surfaces, said pair of wall surfaces connecting to said perpendicular wall surface to form two comers of said each of outermost chambers having the U-shaped cross-section, each of said inner chambers having a rectangular cross-section and being defined by a first pair of wall surfaces which are parallel to said plane and separated from each other by the first dimension A and a second pair of wall surfaces which are perpendicular to said first pair of wall surfaces and separated from each other by a second dimension B, said first pair of wall surfaces connecting to said second pair of wall surfaces to form four comers of each of the inner chambers having the rectangular cross-section, each of the comers of said outermost chambers and said inner chambers having a curvature R determined by the following formula:

$$0.2\ \text{mm} \leqq R \ll D/2,$$

where D equals A when $A \leqq B$ but equals B when $B < A$.

6. A heat exchanger comprising a plurality of refrigerant tubes of a flat type each having an interior and a length and arranged at an interval between each adjacent pair of said refrigerant robes, a plurality of corrugated radiator fins attached to said refrigerant robes to be interposed between each adjacent pair of said plurality of refrigerant tubes, and a pair of header pipes opposite to each other and each having an interior and each located at opposite ends of said plurality of refrigerant robes, respectively, each of said opposite ends of said plurality of refrigerant robes being inserted into one of a plurality of apertures formed in peripheral surfaces of said pair of header pipes and bonded to said pair of header pipes, respectively, so that the interior of said plurality of refrigerant robes communicates with the interior of said pair of header pipes, each of said plurality of refrigerant robes comprising a flat aluminum plate of a length from a first end to a second end with a plurality of chambers extending therein from the first end to the second end and arranged in parallel with each other in a plane parallel to said plate, each of said plurality of chambers being defined to have a rectangular cross-section by a first pair of wall surfaces which are parallel with and separated by a first dimension D from each other and a second pair of wall surfaces which are parallel with and separated by a second dimension greater than or equal to said first dimension from each other and perpendicular to said first pair of wall surfaces, said first pair of wall surfaces connecting to said second pair of wall surfaces to form four comers of each of said chambers having said rectangular cross-section, each of said comers being formed with a curvature R determined by the following formula:

$$0.2\ \text{mm} \leqq R \ll D/2.$$

7. A refrigerant robe as claimed in claim 1, wherein at least said second pair of wall surfaces in each of said plurality of chambers has at least one elongated protrusion extending from said first end to said second end in parallel with said plurality of chambers.

8. A refrigerant robe as claimed in claim 7, wherein a plurality of said elongated protrusions each having a pair of rising edges separated by a width W are formed on at least said second pair of wall surfaces with a distance S remaining between rising edges of two adjacent ones of said elongated protrusions, said width W and said distance S being determined by the following formula:

$$S \leqq W.$$

9. A refrigerant tube as claimed in claim 7, wherein said at least one elongated protrusion has a width W and a height H determined by the following formula:

$$4.5 \times W \leqq H.$$

10. The refrigerant tube as claimed in claim 1, wherein D/2 equals 0.3 mm.

11. The refrigerant tube as claimed in claim 5, wherein D/2 equals 0.3 mm.

12. The refrigerant tube as claimed in claim 6, wherein D/2 equals 0.3 mm.

* * * * *